US011077971B2

(12) United States Patent
Aoki et al.

(10) Patent No.: US 11,077,971 B2
(45) Date of Patent: Aug. 3, 2021

(54) DEVELOPER FILLING METHOD AND DEVELOPER FILLING APPARATUS

(71) Applicant: KONICA MINOLTA, INC., Tokyo (JP)

(72) Inventors: Kentaro Aoki, Toyohashi (JP); Kenzo Toya, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/017,575

(22) Filed: Jun. 25, 2018

(65) Prior Publication Data

US 2019/0002141 A1 Jan. 3, 2019

(30) Foreign Application Priority Data

Jun. 28, 2017 (JP) ..... JP2017-126065

(51) Int. Cl.

| | |
|---|---|
| ***B65B 31/02*** | (2006.01) |
| ***B65B 1/06*** | (2006.01) |
| ***B65B 1/32*** | (2006.01) |
| ***G03G 15/08*** | (2006.01) |
| ***G03G 9/08*** | (2006.01) |

(Continued)

(52) U.S. Cl.

CPC ..... *B65B 31/024* (2013.01); *B65B 1/06* (2013.01); *B65B 1/32* (2013.01); *B65B 7/02* (2013.01); *G03G 9/0808* (2013.01); *G03G 15/0822* (2013.01); *G03G 15/0865* (2013.01);

(Continued)

(58) Field of Classification Search

CPC B65B 31/024; B65B 1/06; B65B 1/32; B65B 7/02; G03G 9/0808; G03G 15/0822; G03G 15/0874; G03G 15/0894; G03G 21/181

See application file for complete search history.

(56) References Cited

U.S. PATENT DOCUMENTS 4,332,334 A * 6/1982 Mian ..... B65B 69/0008 222/203
5,832,349 A * 11/1998 Nagashima ..... G03G 15/0884 399/262

(Continued)

FOREIGN PATENT DOCUMENTS

FR 2554759 A1 * 5/1985 ..... B28C 7/064
JP H09-251232 A 9/1997

(Continued)

OTHER PUBLICATIONS

FR2554759, English Translation (Year: 1983).*

(Continued)

*Primary Examiner* — Timothy P. Kelly
*Assistant Examiner* — Christopher M Afful
(74) *Attorney, Agent, or Firm* — Buchanan Ingersoll & Rooney PC

(57) ABSTRACT

A developer filling apparatus includes a bag setting portion where a developer bag in which a developer containing toner and a carrier is sealed is set, an accommodation case setting portion where a developer accommodation case for accommodating the developer is set, and a transfer path constructed to initially fill the developer accommodation case set in the accommodation case setting portion with the developer taken out of the opened developer bag while the developer bag is set in the bag setting portion.

15 Claims, 17 Drawing Sheets

(51) Int. Cl.
*B65B 7/02* (2006.01)
*G03G 21/18* (2006.01)

(52) U.S. Cl.
CPC ..... *G03G 15/0874* (2013.01); *G03G 15/0894* (2013.01); *G03G 21/181* (2013.01)

(56) References Cited

U.S. PATENT DOCUMENTS

| | | | | |
|---|---|---|---|---|
| 2005/0089347 | A1* | 4/2005 | Muramatsu ..... | G03G 15/0874 399/262 |
| 2013/0082073 | A1* | 4/2013 | Eversole ..... | B65D 88/66 222/196 |

FOREIGN PATENT DOCUMENTS

| | | | |
|---|---|---|---|
| JP | H09-265232 | A | 10/1997 |
| JP | H11-052695 | A | 2/1999 |
| JP | 2000-098720 | A | 4/2000 |
| JP | 2000-155458 | A | 6/2000 |
| JP | 2004-264510 | A | 9/2004 |
| JP | 2005-091879 | A | 4/2005 |
| JP | 2010-197531 | A | 9/2010 |
| JP | 2016-024330 | A | 2/2016 |

OTHER PUBLICATIONS

Office Action (Notice of Reasons for Refusal) dated Feb. 9, 2021, by the Japanese Patent Office in corresponding Japanese Patent Application No. 2017-126065 and English translation of the Office Action. (18 pages).

* cited by examiner

DEVELOPER FILLING METHOD AND DEVELOPER FILLING APPARATUS

The entire disclosure of Japanese Patent Application No. 2017-126065 filed on Jun. 28, 2017 is incorporated herein by reference in its entirety.

BACKGROUND

Technological Field

The present invention relates to a developer filling method and a developer filling apparatus for filling a developer accommodation case with a developer containing toner and a carrier.

Description of the Related Art

A developer used in a copying machine contains toner and a carrier as being mixed and a ratio of mixing is strictly controlled. When a developer accommodation case loaded into an image formation apparatus is filled with the developer, the toner and the carrier in the developer should be uniformly mixed at a prescribed ratio.

Japanese Laid-Open Patent Publications Nos. 2004-264510 and 2010-197531 disclose a method of filling a developer accommodation case with a developer in mass production sites.

In Japanese Laid-Open Patent Publication No. 2004-264510, toner and a carrier are accurately weighed for each batch and mixed in advance by using an agitator such as a large drum mixer or a V-mixer. A developer accommodation case is filled with the toner and the carrier after they are uniformly agitated.

In Japanese Laid-Open Patent Publication No. 2010-197531, instead of mixing toner and a carrier in advance in a batch, a developer accommodation case is filled with the toner and the carrier while they are continuously mixed and agitated.

SUMMARY

An approach to agitate and mix toner and a carrier in advance in a batch as described in Japanese Laid-Open Patent Publication No. 2004-264510, however, requires a process for agitating and mixing a large amount of toner and carrier as well as facilities for agitation and mixing. Therefore, extra time, cost, and operation space are required and the process is costly.

In an approach for filling while the toner and the carrier are continuously agitated and mixed as described in Japanese Laid-Open Patent Publication No. 2010-197531, it is difficult to keep a ratio of mixing between the toner and the carrier constant and to secure quality such as uniform agitation. Unlike the batch approach, control of lots is difficult, and when a quality issue arises, traceability is poor and analysis of a cause is difficult, which leads to cost for securing and controlling quality.

The present invention was made in view of the problems as above, and an object of the present invention is to provide a developer filling method and a developer filling apparatus for individually filling a developer accommodation case with a developer in which toner and a carrier are mixed at an accurate ratio of mixing, the developer being prepared in small batches in containers for filling of the developer accommodation case.

To achieve at least one of the abovementioned objects, according to an aspect of the present invention, a developer filling method reflecting one aspect of the present invention comprises opening a developer bag where a developer containing toner and a carrier is sealed and taking out the developer from the opened developer bag and initially filling a developer accommodation case with the developer through a transfer path.

To achieve at least one of the abovementioned objects, according to an aspect of the present invention, a developer filling apparatus reflecting one aspect of the present invention comprises a bag setting portion where a developer bag in which a developer containing toner and a carrier is sealed is set, an accommodation case setting portion where a developer accommodation case for accommodating the developer is set, and a transfer path constructed to initially fill the developer accommodation case set in the accommodation case setting portion with the developer taken out of the opened developer bag while the developer bag is set in the bag setting portion.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
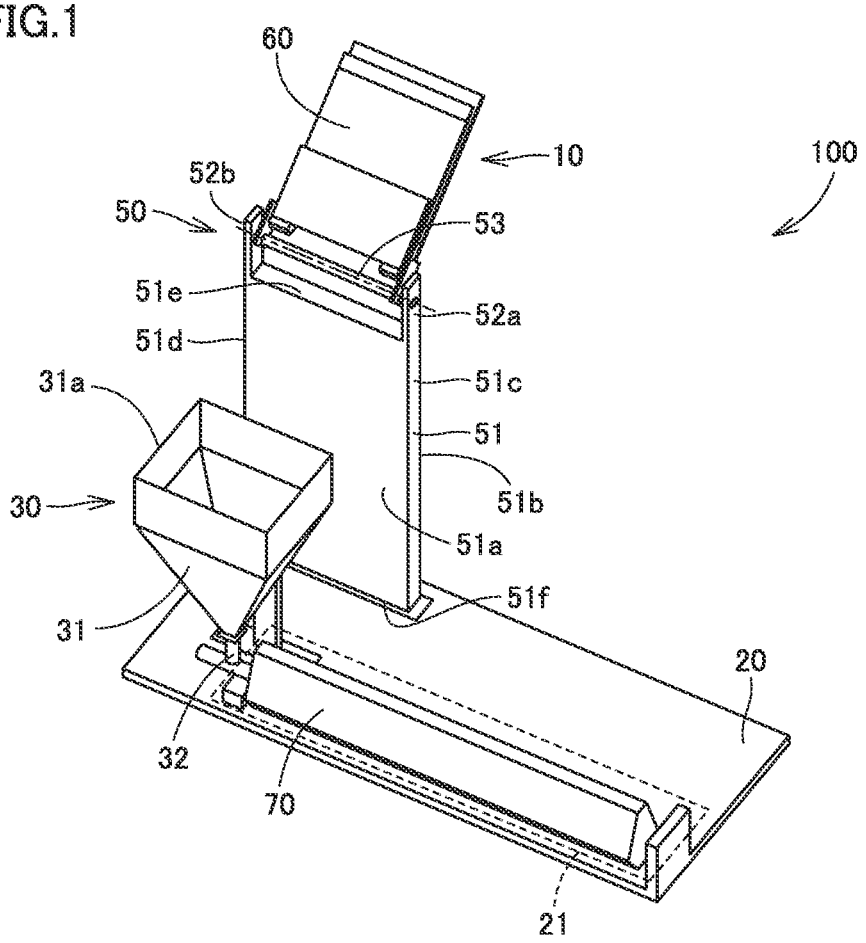
FIG. 1 is a perspective view showing a developer filling apparatus according to a first embodiment.

Hereinafter, one or more embodiments of the present invention will be described with reference to the drawings. However, the scope of the invention is not limited to the disclosed embodiments.

In embodiments shown below, identical or common elements have the same reference characters allotted in the drawings and description thereof will not be repeated.

First Embodiment

FIG. 1 is a perspective view showing a developer filling apparatus according to a first embodiment. A developer filling apparatus 100 according to the first embodiment will be described with reference to FIG. 1.

Developer filling apparatus 100 includes a bag setting portion 10, a base portion 20, a transfer path 30, and a posture change portion 50.

In bag setting portion 10, a developer bag 60 where a developer containing toner and a carrier is sealed is set. An upper side of developer bag 60 is opened while developer bag 60 is set in bag setting portion 10. Bag setting portion 10 is provided at a position higher than an upper end of transfer path 30. Bag setting portion 10 is pivotably supported by posture change portion 50.

Base portion 20 is substantially in a form of a plate. Transfer path 30 and posture change portion 50 are fixed to base portion 20. An accommodation case setting portion 21 in which a developer accommodation case 70 for accommodating a developer is set is provided on base portion 20.

Transfer path 30 is a path constructed to initially fill developer accommodation case 70 set in accommodation case setting portion 21 with the developer taken out of opened developer bag 60 while it is set in bag setting portion 10.

Transfer path 30 is provided on one end side of base portion 20. Transfer path 30 is provided to be opposed to posture change portion 50. Transfer path 30 includes a hopper portion 31 and a feed path 32.

Hopper portion 31 defines an upper portion of transfer path 30. Hopper portion 31 includes an opening 31*a* which opens upward. Hopper portion 31 is in a tapered shape having a lower end side tapered. Hopper portion 31 stores a developer taken out of the developer bag.

Feed path 32 defines a lower portion of transfer path 30. Feed path 32 has one end side connected to a lower end of hopper portion 31. Feed path 32 has the other end side connected to developer accommodation case 70 set in accommodation case setting portion 21. Feed path 32 is a path constructed to feed a developer from hopper portion 31 into developer accommodation case 70.

Posture change portion 50 changes a posture of developer bag 60 such that a mouth of developer bag 60 opened while the developer bag is set in bag setting portion 10 is oriented to transfer path 30.

Posture change portion 50 includes a support base 51 and a shaft 53. Support base 51 is in a form of a plate. Specifically, support base 51 includes main surfaces 51*a* and 51*b* which face each other, side surfaces 51*c* and 51*d* which face each other, and an upper end surface 51*e* and a lower end surface 51*f* which face each other in a vertical direction. Protrusions 52*a* and 52*b* protruding upward are provided on opposing side surface sides of upper end surface 51*e* of support base 51, respectively.

Protrusion 52*a* and protrusion 52*b* are arranged at a distance from each other in a direction in which side surface 51*c* and side surface 51*d* are aligned. Shaft 53 is provided as a bridge between protrusion 52*a* and protrusion 52*b*. Bag setting portion 10 is pivotably fixed to shaft 53. Bag setting portion 10 is fixed to shaft 53 as being pivotable around shaft 53.

Figure 2:
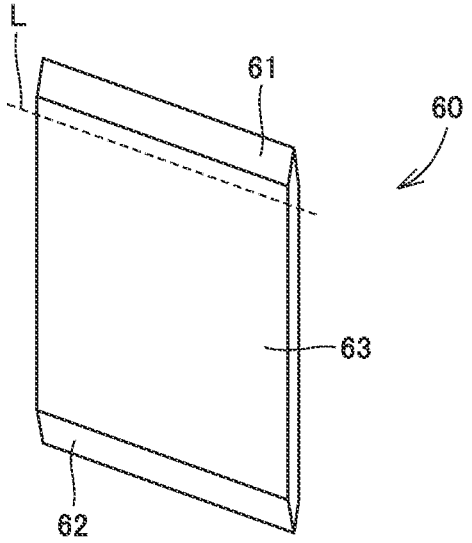
FIG. 2 is a perspective view of a developer bag used for the developer filling apparatus according to the first embodiment.

FIG. 2 is a perspective view of the developer bag used for the developer filling apparatus according to the first embodiment. Developer bag 60 will be described with reference to FIG. 2.

As shown in FIG. 2, developer bag 60 includes an accommodation portion 63 in which a developer is accommodated and fused portions 61 and 62 for hermetically sealing the developer in accommodation portion 63. Developer bag 60 is formed by fusing opening ends located on opposing ends of a cylindrically wound film. Developer bag 60 may be formed by layering two films and fusing edges of the films in a form of a frame.

A thermally fusible sheet-like member such as an aluminum sheet and a vinyl sheet can be adopted as the film.

The developer is obtained by mixing toner and a carrier at a prescribed ratio. The toner is not particularly limited and known toner which is generally used can be employed. Toner in which a coloring agent as well as a charge control agent and a release agent are contained as necessary in a binder resin and which is treated further with an additive can be employed as the toner.

The carrier is not particularly limited and a known carrier which is generally used can be employed. For example, a binder type carrier and a coating type carrier can be employed.

In opening developer bag 60, a cutting mechanism 80 (see FIG. 6) which will be described later is used to cut developer bag 60 in a portion located on a side of accommodation portion 63 relative to fused portions 61 and 62. Specifically, when developer bag 60 is set in bag setting portion 10 such that fused portion 61 is located on an upper side, developer bag 60 is cut along a cut line L located in the vicinity of a lower side of fused portion 61.

Since fused portion 61 is in a tightly closing state, no developer is present therein. Therefore, by cutting the vicinity of fused portion 61, collapse of the developer by a cutting blade at the time of cutting and resultant generation of an aggregate can be suppressed.

Figure 3:
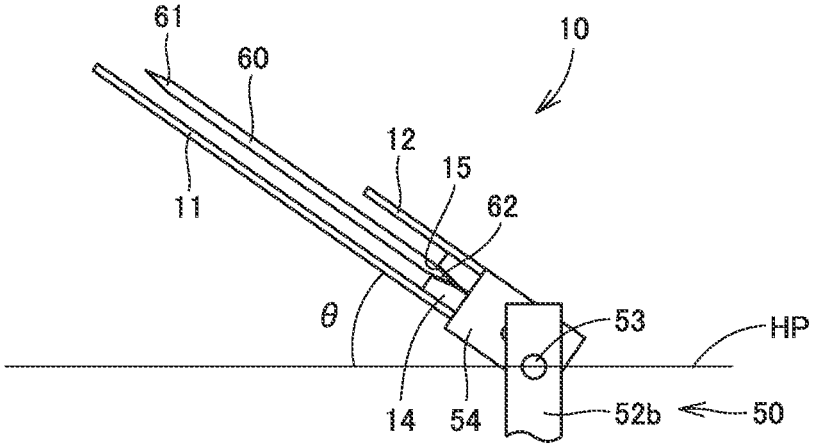
FIG. 3 is a side view of a bag setting portion and a posture change portion with the developer bag having been set in the bag setting portion of the developer filling apparatus according to the first embodiment.

FIG. 3 is a side view of the bag setting portion and the posture change portion with the developer bag having been set in the bag setting portion of the developer filling apparatus according to the first embodiment. Bag setting portion 10 and posture change portion 50 will be described in detail with reference to FIG. 3.

As shown in FIG. 3, bag setting portion 10 is constructed such that developer bag 60 is set as being inclined with respect to a horizontal plane HP. Bag setting portion 10 is inclined such that an end portion far from horizontal plane HP is located above horizontal plane HP. The end portion far from horizontal plane HP is located opposite to a side where transfer path 30 is located, with respect to support base 51.

An angle θ formed between developer bag 60 and horizontal plane HP is preferably not smaller than 15° and not greater than 165°. With an angle of inclination being within this range, the developer remaining on cutting line L can be suppressed in cutting developer bag 60 along cutting line L. Thus, collapse of the developer remaining on cutting line L by a cutting blade at the time of cutting and resultant generation of an aggregate can be suppressed. By inclining developer bag 60 and collecting the developer in a lower portion, scattering of the developer at the time of pivot of bag setting portion 10 or introduction of the developer into transfer path 30 can be suppressed.

Bag setting portion 10 includes a first plate-shaped portion 11, a second plate-shaped portion 12, and a fixing portion 14. First plate-shaped portion 11 is a portion located on a side of a rear surface of set developer bag 60. First plate-shaped portion 11 is greater in size than developer bag 60. First plate-shaped portion 11 is opposed to the entire developer bag 60.

Second plate-shaped portion 12 is a portion located on a side of a front surface of set developer bag 60. Second plate-shaped portion 12 is provided as being opposed to a lower portion of first plate-shaped portion 11. Second plate-shaped portion 12 is smaller than first plate-shaped portion 11 and an upper portion of first plate-shaped portion 11 is exposed when the second plate-shaped portion is opposed to first plate-shaped portion 11.

Developer bag 60 is set between first plate-shaped portion 11 and second plate-shaped portion 12. While developer bag 60 is set in bag setting portion 10, an upper portion of developer bag 60 (more specifically, fused portion 61) is exposed through second plate-shaped portion 12. Consequently, developer bag 60 can be cut along cutting line L in the vicinity of fused portion 61.

Fixing portion 14 fixes developer bag 60 set in bag setting portion 10. Fixing portion 14 is provided between a lower end side of first plate-shaped portion 11 and a lower end side of second plate-shaped portion 12. Fixing portion 14 is attached to first plate-shaped portion 11 and second plate-shaped portion 12.

Fixing portion 14 includes an insertion portion 15 in which fused portion 62 of developer bag 60 is inserted. Fused portion 62 is press-fitted to insertion portion 15. Fused portion 62 is thus held by fixing portion 14 so that developer bag 60 is fixed to fixing portion 14.

Fused portion 62 is a region where no developer is present. Therefore, by holding fused portion 62, generation of an aggregate due to holding can be suppressed.

Fixing portion 14 is not limited to such an embodiment and it may be implemented by a suction portion provided in first plate-shaped portion 11. In this case, developer bag 60 is fixed by suctioning by the suction portion.

Posture change portion 50 includes a pair of connection pieces 54. The pair of connection pieces 54 connects side surfaces of first plate-shaped portion 11 and second plate-shaped portion 12 to each other on opposing side surface sides thereof. The pair of connection pieces 54 is in a form of a plate. The pair of connection pieces 54 is provided to protrude from a lower end of first plate-shaped portion 11 and a lower end of second plate-shaped portion 12 along a direction of extension of the side surfaces of first plate-shaped portion 11 and second plate-shaped portion 12.

A portion of the pair of connection pieces 54 which protrudes from the lower end of first plate-shaped portion 11 and the lower end of second plate-shaped portion 12 as above is provided with a through hole. Shaft 53 of posture change portion 50 passes through the through hole.

The pair of connection pieces 54 and shaft 53 implement a pivot mechanism which has bag setting portion 10 pivot. The pivot mechanism has bag setting portion 10 pivot such that bag setting portion 10 in a portion located on a side of the mouth of opened developer bag 60 is oriented to transfer path 30.

The pivot mechanism is preferably constructed to have bag setting portion 10 pivot by 180 degrees or more. In this case, even when developer bag 60 is set in bag setting portion 10 as being inclined with respect to horizontal plane HP as above, the mouth of opened developer bag 60 can be oriented downward by having bag setting portion 10 pivot by 180 degrees or more. The developer remaining in developer bag 60 can thus be suppressed. Alteration of quality of the developer can be suppressed and the developer can be introduced into transfer path 30 without causing insufficient supply.

Figure 4:
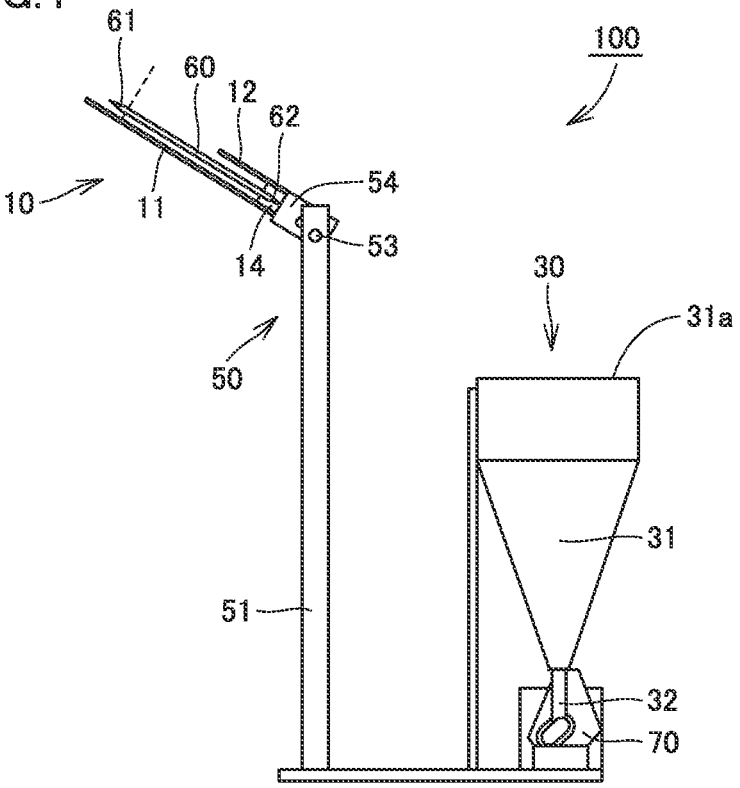
FIG. 4 is a side view showing a first state of the developer filling apparatus according to the first embodiment.
Figure 5:
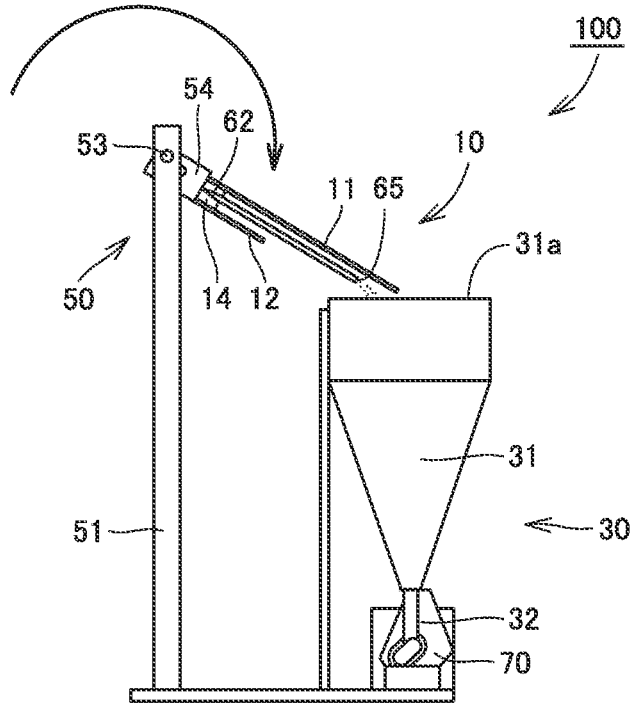
FIG. 5 is a side view showing a second state of the developer filling apparatus according to the first embodiment.

FIG. 4 is a side view showing a first state of the developer filling apparatus according to the first embodiment. FIG. 5 is a side view showing a second state of the developer filling apparatus according to the first embodiment. An operation of the developer filling apparatus according to the first embodiment will be described with reference to FIGS. 4 and 5.

As shown in FIG. 4, in the first state, developer bag 60 is set in bag setting portion 10. Developer bag 60 is fixed to bag setting portion 10 by fixing portion 14. Developer bag 60 is set in bag setting portion 10 such that fused portion 61 opposite to fused portion 62 on a side where the developer bag is held by fixing portion 14 is located above fused portion 62. Fused portion 61 is exposed through second plate-shaped portion 12 of bag setting portion 10. A portion shown with a dashed line is cut in this state so that developer bag 60 is opened.

As shown in FIG. 5, in the second state, while opened developer bag 60 is fixed to bag setting portion 10, bag setting portion 10 pivots such that bag setting portion 10 in the portion located on the side of a mouth 65 is oriented to transfer path 30.

In this state, mouth 65 of developer bag 60 is located above opening 31*a* of hopper portion 31. Developer bag 60 is fixed to bag setting portion 10 such that mouth 65 is located below fused portion 62 on the side where the developer bag is held by fixing portion 14.

The developer is thus taken out of developer bag 60 from mouth 65 and introduced into hopper portion 31. While the developer introduced into hopper portion 31 is stored in hopper portion 31, developer accommodation case 70 is filled with the developer through feed path 32.

Figure 6:
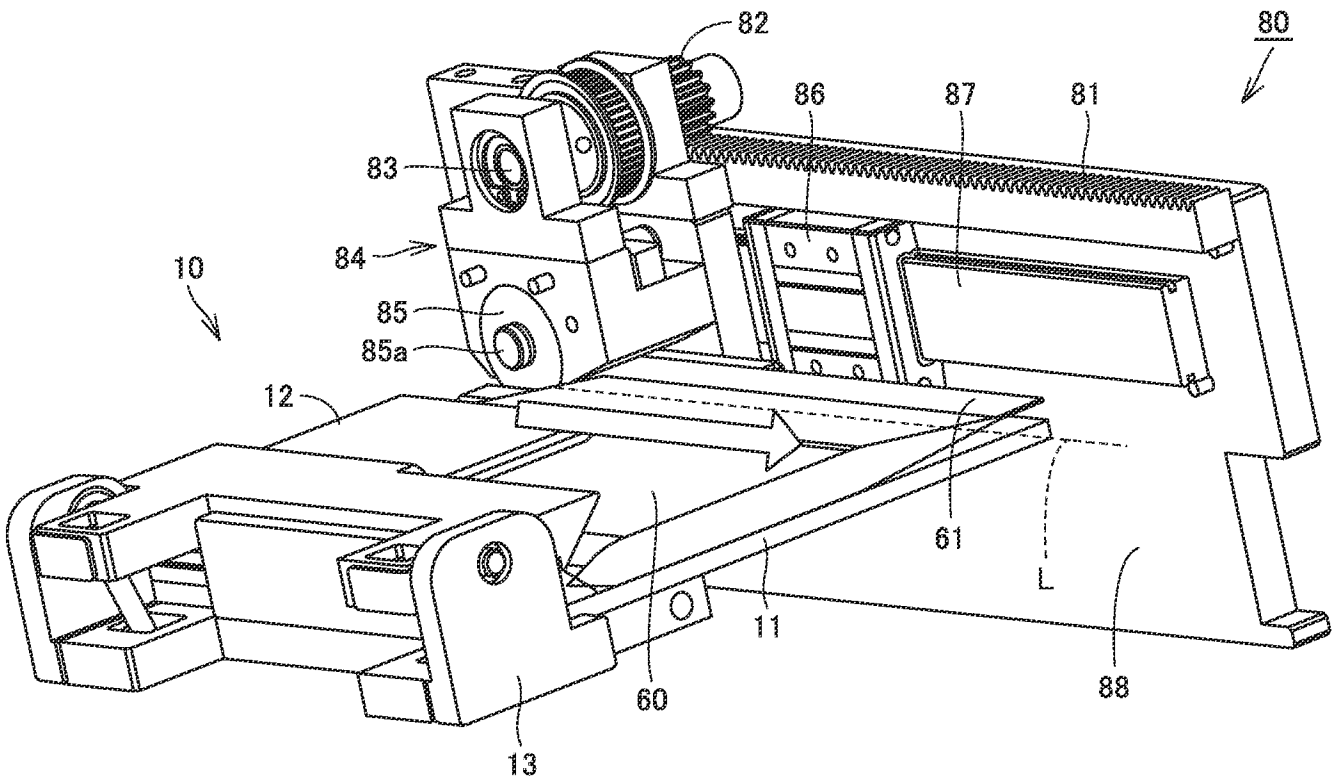
FIG. 6 is a perspective view showing a cutting mechanism of the developer filling apparatus according to the first embodiment.

FIG. 6 is a perspective view showing the cutting mechanism of the developer filling apparatus according to the first embodiment. Cutting mechanism 80 will be described with reference to FIG. 6.

Cutting mechanism 80 includes a rack portion 81, a gear portion 82, a drive portion 83, a support block 84, a rotary blade 85, a guided portion 86, a guide rail 87, and a support wall 88.

Rack portion 81 extends in a direction in parallel to cutting line L. Rack portion 81 is fixed to support wall 88. Gear portion 82 is constructed to be able to run on rack portion 81. Gear portion 82 is rotated by drive portion 83. Drive portion 83 and rotary blade 85 are supported by support block 84. Support block 84 moves in the direction in parallel to cutting line L as gear portion 82 runs on rack portion 81.

Support block 84 is connected to guided portion 86. Guided portion 86 is engaged as being slidable with respect to guide rail 87 fixed to support wall 88. Movement of guided portion 86 is guided by guide rail 87.

Guide rail 87 extends in the direction in parallel to cutting line L and guided portion 86 moves in the direction in parallel to cutting line L. As movement of guided portion 86 is guided by guide rail 87, movement of support block 84 is stabilized.

With movement of support block 84, substantially circular rotary blade 85 moves in the direction in parallel to the direction of extension of fused portion 61, that is, along cutting line L, while it rotates around a rotation shaft 85*a*. Fused portion 61 of developer bag 60 is thus cut and developer bag 60 is opened.

By thus cutting developer bag 60 while rotary blade 85 rotates, a resistance in cutting can be lowered. Thus, even when developer bag 60 is in a form of a thin film, there is no possibility of failure in cutting. In addition, production of chips during cutting can be lessened.

Figure 7:
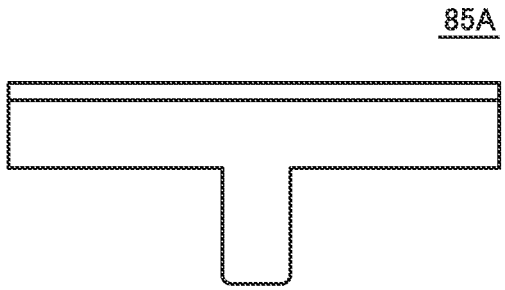
FIG. 7 is a plan view showing a cutting blade included in the cutting mechanism according to a first modification.

FIG. 7 is a plan view showing a cutting blade included in the cutting mechanism according to a first modification. As shown in FIG. 7, a plate-shaped blade 85A may be employed instead of rotary blade 85 according to the first embodiment. Plate-shaped blade 85A extends in the direction in parallel to the direction of extension of fused portion 61 (in the direction in parallel to cutting line L).

In this case, a cutting mechanism (not shown) according to the first modification is constructed to press a tip end portion of plate-shaped blade 85A against developer bag 60 along cutting line L. Specifically, the cutting mechanism according to the first modification includes plate-shaped blade 85A, a pushing portion (not shown) for pushing plate-shaped blade 85A toward developer bag 60, and a drive portion (not shown) for moving the pushing portion.

Plate-shaped blade 85A is pressed against developer bag 60 along cutting line L so that fused portion 61 is cut and developer bag 60 is opened.

By thus pressing plate-shaped blade 85A to cut developer bag 60 with shear force and by stabbing plate-shaped blade 85A by a defined amount, cutting can be achieved without residues caused by shearing. The blade can relatively be large in thickness and durability can be enhanced.

(Developer Filling Method)

Figure 8:
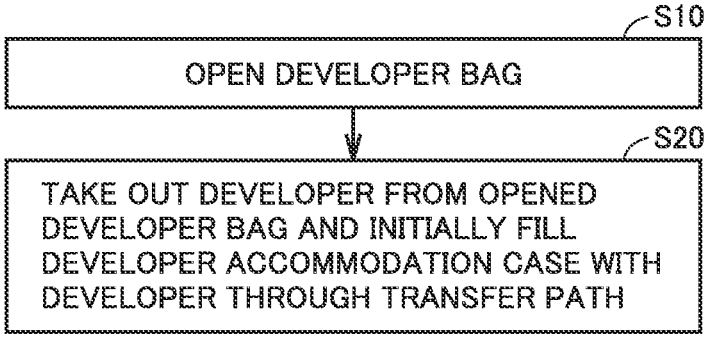
FIG. 8 is a flowchart of a developer filling method according to the first embodiment.

FIG. 8 is a flowchart of a developer filling method according to the first embodiment. The developer filling method according to the first embodiment will be described with reference to FIG. 8.

As shown in FIG. 8, in the developer filling method according to the first embodiment, initially, in a step S10, developer bag 60 in which a developer containing toner and a carrier is sealed is opened.

Specifically, developer bag 60 is set in bag setting portion 10 and a part of developer bag 60 is cut. Developer bag 60 is set in bag setting portion 10 such that fused portion 61 opposite to fused portion 62 on the side where the developer bag is held in fixing portion 14 is located above fused portion 62. In this state, developer bag 60 in a portion located on an inner side of fused portion 61 is cut along the direction in parallel to the direction of extension of fused portion 61 (along cutting line L) to open developer bag 60.

Then, in a step S20, the developer is taken out of opened developer bag 60 and developer accommodation case 70 is initially filled therewith through transfer path 30.

Specifically, while opened developer bag 60 is fixed to bag setting portion 10, bag setting portion 10 pivots such that bag setting portion 10 in the portion located on the side of mouth 65 is oriented to transfer path 30. The developer is thus taken out of developer bag 60 through mouth 65 and introduced into hopper portion 31. While the developer introduced into hopper portion 31 is stored in hopper portion 31, developer accommodation case 70 is filled with the developer through feed path 32.

By using developer filling apparatus 100 and the developer filling method according to the first embodiment as above, developer bag 60 in which toner and a carrier are mixed at an accurate ratio of mixing can be opened, the developer can be taken out of opened developer bag 60, and developer accommodation case 70 can initially be filled therewith through transfer path 30. It is thus unnecessary to separately provide facilities for agitation and mixing for mixing toner and a carrier at a site of filling of the developer accommodation case with the developer and facilities or a process can be facilitated at the site of filling with the developer.

In addition, by using developer bag 60 in which the developer in which toner and a carrier are mixed at an accurate ratio of mixing is sealed, the developer being prepared in each one batch for initial filling, a ratio of mixing of the developer, quality such as an amount of filling, and traceability can be enhanced. Consequently, quality can readily be secured and controlled and cost for initial filling with the developer can be reduced.

Second Embodiment (Developer Filling Apparatus)

Figure 9:
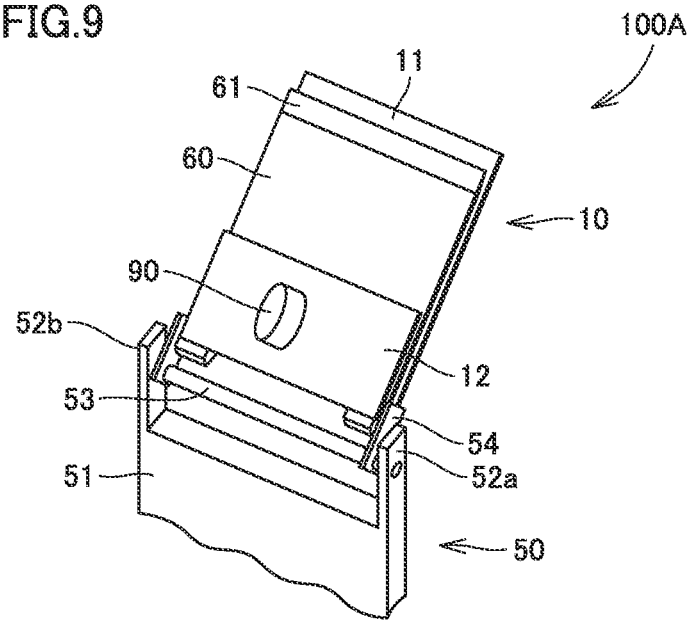
FIG. 9 is a perspective view showing the bag setting portion, the posture change portion, and a vibration portion in a developer filling apparatus according to a second embodiment.

FIG. 9 is a perspective view showing the bag setting portion, the posture change portion, and a vibration portion in a developer filling apparatus according to a second embodiment. A developer filling apparatus 100A according to the second embodiment will be described with reference to FIG. 9.

As shown in FIG. 9, developer filling apparatus 100A according to the second embodiment is different from developer filling apparatus 100 according to the first embodiment in including a vibration portion 90 and otherwise substantially the same in construction.

Vibration portion 90 vibrates the developer by the time developer accommodation case 70 is filled with the developer. Specifically, vibration portion 90 is provided in bag setting portion 10 and vibrates the developer accommodated in developer bag 60 set in bag setting portion 10 by vibrating bag setting portion 10.

For example, an air vibrator, an electric vibrator, and a high-frequency vibrator can be adopted for vibration portion 90.

Figure 10:
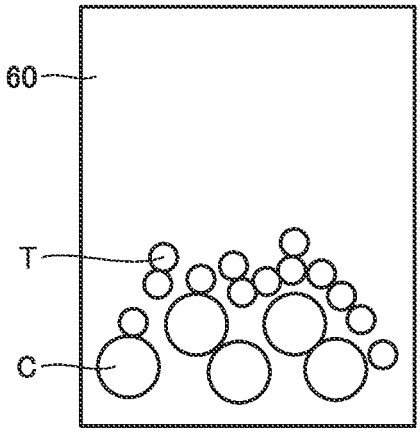
FIG. 10 is a schematic diagram showing a developer accommodated in the developer bag before vibration in the developer filling apparatus according to the second embodiment.

FIG. 10 is a schematic diagram showing the developer accommodated in the developer bag before vibration in the developer filling apparatus according to the second embodiment. The developer accommodated in developer bag 60 before vibration will be described with reference to FIG. 10.

As shown in FIG. 10, in developer bag 60 before vibration, a carrier C and toner T are mixed at a desired ratio, however, a distribution of carrier C and toner T may be uneven.

Figure 11:
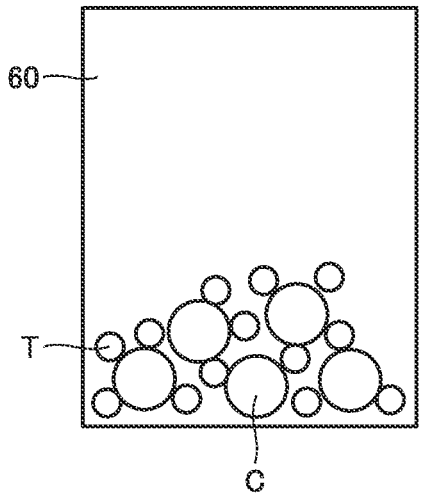
FIG. 11 is a schematic diagram showing the developer accommodated in the developer bag after vibration in the developer filling apparatus according to the second embodiment.

FIG. 11 is a schematic diagram showing the developer accommodated in the developer bag after vibration in the developer filling apparatus according to the second embodiment. The developer accommodated in developer bag 60 after vibration will be described with reference to FIG. 11.

As shown in FIG. 11, in developer bag 60 after yet-to-be-opened developer bag 60 is vibrated by vibration portion 90, carrier C and toner T are uniformly mixed. By thus vibrating developer bag 60 with vibration portion 90, filling of developer accommodation case 70 with the developer with the distribution of carrier C and toner T being uneven can be suppressed.

(Developer Filling Method)

Figure 12:
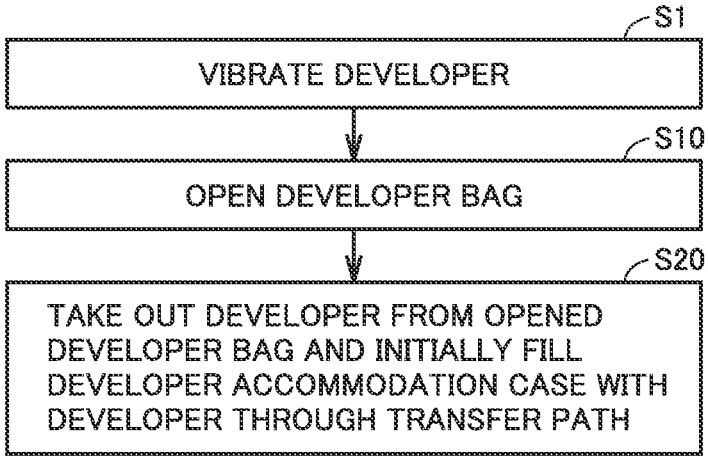
FIG. 12 is a flowchart of a developer filling method according to the second embodiment.

FIG. 12 is a flowchart of a developer filling method according to the second embodiment. The developer filling method according to the second embodiment will be described with reference to FIG. 12.

As shown in FIG. 12, in the developer filling method according to the second embodiment, the developer is vibrated in a step S1. Specifically, developer bag 60 is set in bag setting portion 10 and vibration portion 90 vibrates bag setting portion 10. Developer bag 60 set in bag setting portion 10 is thus vibrated and the developer accommodated in developer bag 60 is vibrated. The developer is thus vibrated by the time developer accommodation case 70 is filled with the developer. In succession, in step S10 and step S20, the process the same as in the first embodiment is performed. Consequently, developer accommodation case 70 is initially filled with the developer with carrier C and toner T being uniformly mixed.

With developer filling apparatus 100A and the developer filling method according to the second embodiment as above, an effect substantially equivalent to that in the first embodiment is obtained.

By vibrating the developer accommodated in developer bag 60, developer accommodation case 70 can initially be filled with the developer with the toner and the carrier mixed at a desired ratio of mixing being uniformly agitated.

Figure 13:
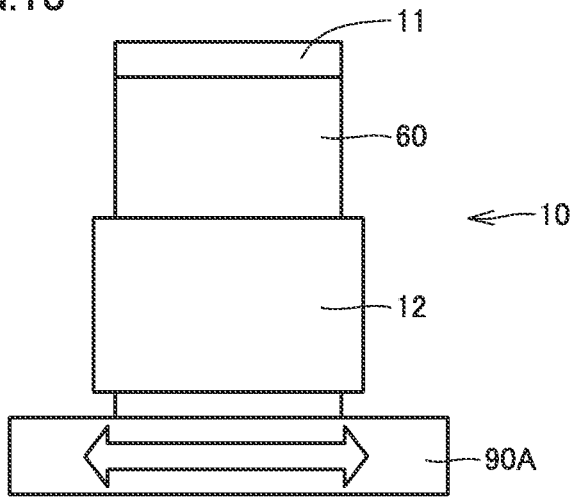
FIG. 13 is a diagram showing a vibration portion according to a second modification.

FIG. 13 is a diagram showing a vibration portion according to a second modification. A vibration portion 90A according to the second modification will be described with reference to FIG. 13.

As shown in FIG. 13, vibration portion 90A is implemented by a swaying mechanism which sways bag setting portion 10 as a whole. The swaying mechanism includes, for example, a linearly moving cylinder. Such vibration portion 90A may be employed as the vibration portion constructed to vibrate the developer accommodated in developer bag 60.

Though an example in which the developer filling apparatus includes vibration portion 90 or 90A and vibration portion 90 or 90A vibrates developer bag 60 in step S1 is described by way of example in the second embodiment and the second modification, limitation thereto is not intended. The developer filling apparatus does not have to include vibration portion 90 or 90A but an operator may directly vibrate developer bag 60 in step S1.

Third Embodiment (Developer Filling Apparatus)

Figure 14:
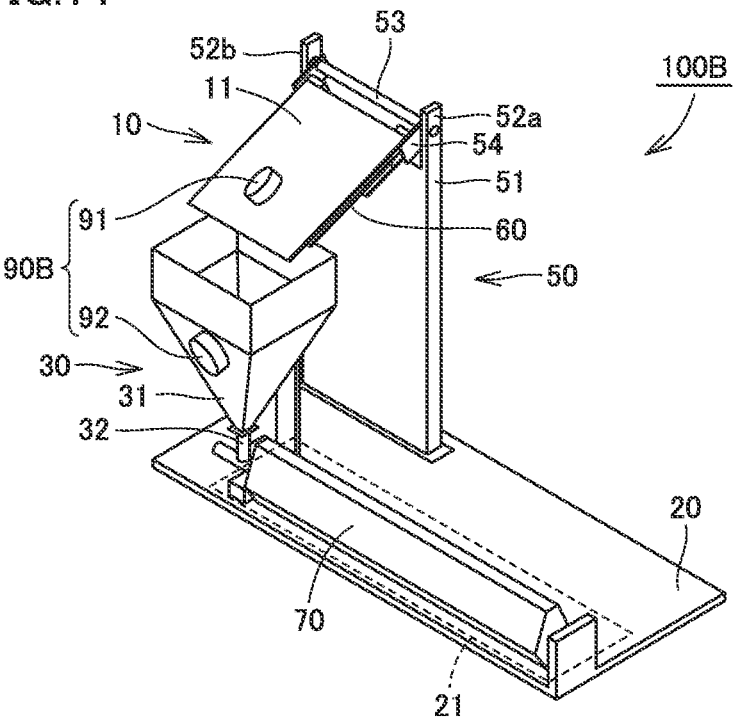
FIG. 14 is a perspective view showing a developer filling apparatus according to a third embodiment.

FIG. 14 is a perspective view showing a developer filling apparatus according to a third embodiment. A developer filling apparatus 100B according to the third embodiment will be described with reference to FIG. 14.

As shown in FIG. 14, developer filling apparatus 100B according to the third embodiment is different from developer filling apparatus 100A according to the second embodiment in construction of a vibration portion 90B and otherwise substantially the same in construction.

Vibration portion 90B includes a first vibration portion 91 and a second vibration portion 92. First vibration portion 91 is provided in bag setting portion 10. First vibration portion 91 is substantially the same in construction as vibration portion 90 according to the second embodiment.

Second vibration portion 92 is provided in transfer path 30. Second vibration portion 92 vibrates the developer introduced into transfer path 30 by vibrating transfer path 30. More specifically, second vibration portion 92 is provided in hopper portion 31. By vibrating hopper portion 31, the developer stored in hopper portion 31 is vibrated. Toner and a carrier can thus more effectively be mixed.

For example, an air vibrator, an electric vibrator, and a high-frequency vibrator can be adopted for first vibration portion 91 and second vibration portion 92.

(Developer Filling Method)

Figure 15:
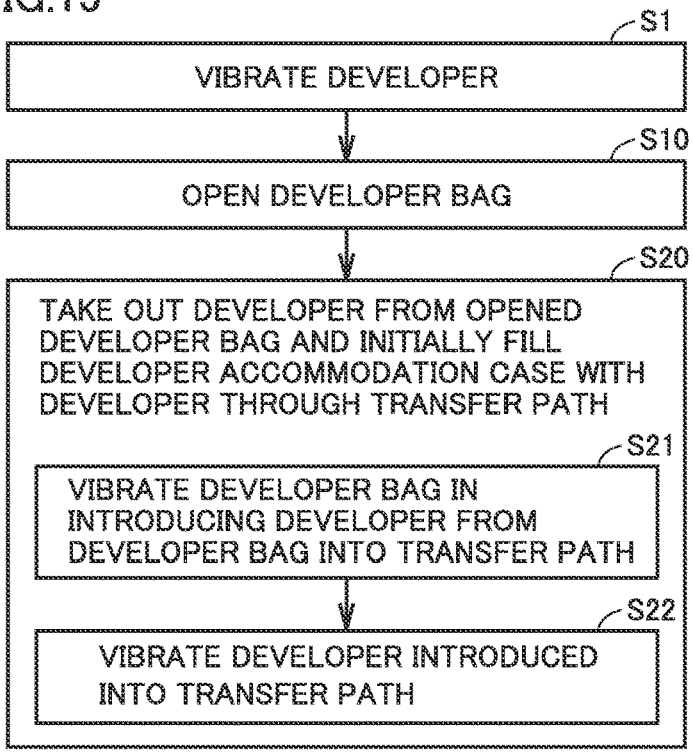
FIG. 15 is a flowchart of a developer filling method according to the third embodiment.

FIG. 15 is a flowchart of a developer filling method according to the third embodiment. The developer filling method according to the third embodiment will be described with reference to FIG. 15.

As shown in FIG. 15, in the developer filling method according to the third embodiment, the developer is vibrated in step S1. Specifically, the process substantially the same as in the second embodiment is performed. In succession, in step S10, developer bag 60 in which the developer containing toner and the carrier is sealed is opened. Specifically, the process substantially the same as in the first embodiment is performed.

In succession, in step S20, the developer is taken out of opened developer bag 60 and developer accommodation case 70 is initially filled therewith through transfer path 30. Step S20 includes steps S21 and S22. In step S21, in introducing the developer from developer bag 60 into transfer path 30, developer bag 60 is vibrated. Specifically, first vibration portion 91 vibrates bag setting portion 10 so that developer bag 60 fixed to bag setting portion 10 is vibrated. The developer remaining in developer bag 60 can thus be suppressed.

In step S22, second vibration portion 92 provided in transfer path 30 vibrates. The developer introduced into transfer path 30 is thus vibrated. Consequently, developer accommodation case 70 is initially filled with the developer with carrier C and toner T being uniformly mixed.

With developer filling apparatus 100B and the developer filling method according to the third embodiment as above, an effect substantially equivalent to that in the second embodiment is obtained.

Developer bag 60 is vibrated when the developer is introduced from developer bag 60 into transfer path 30 so that the developer remaining in developer bag 60 can be suppressed.

By vibrating transfer path 30, developer accommodation case 70 can initially be filled with the developer with carrier C and toner T being uniformly mixed and the developer remaining in transfer path 30 can be suppressed.

Fourth Embodiment (Developer Filling Apparatus)

Figure 16:
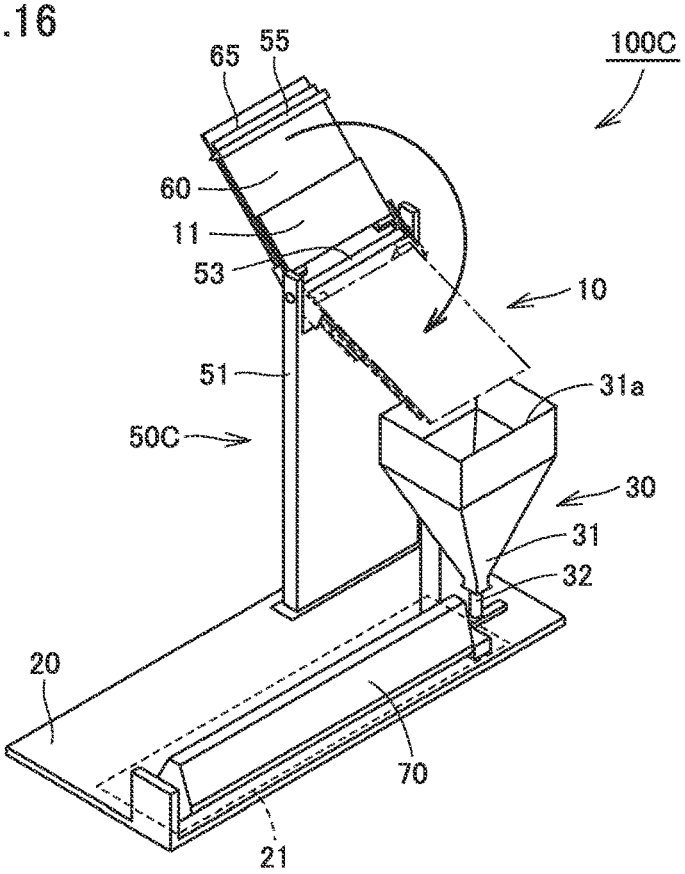
FIG. 16 is a perspective view showing a developer filling apparatus according to a fourth embodiment.

FIG. 16 is a perspective view showing a developer filling apparatus according to a fourth embodiment. A developer filling apparatus 100C according to the fourth embodiment will be described with reference to FIG. 16.

As shown in FIG. 16, developer filling apparatus 100C according to the fourth embodiment is different from developer filling apparatus 100 according to the first embodiment in construction of a posture change portion 50C and otherwise substantially the same in construction.

Posture change portion 50C is different from posture change portion 50 according to the first embodiment in including a pressing portion 55 and otherwise substantially the same in construction.

Pressing portion 55 is constructed to press developer bag 60 set in bag setting portion 10. Pressing portion 55 extends in the direction of extension of fused portion 61 (the direction in parallel to cutting line L).

Pressing portion 55 presses mouth 65 of opened developer bag 60 so as to allow opening and closing thereof. For example, a rubber blade can be adopted for pressing portion 55.

By pressing mouth 65 with pressing portion 55, mouth 65 is closed. By moving pressing portion 55 away from mouth 65, mouth 65 is opened.

Figure 17:
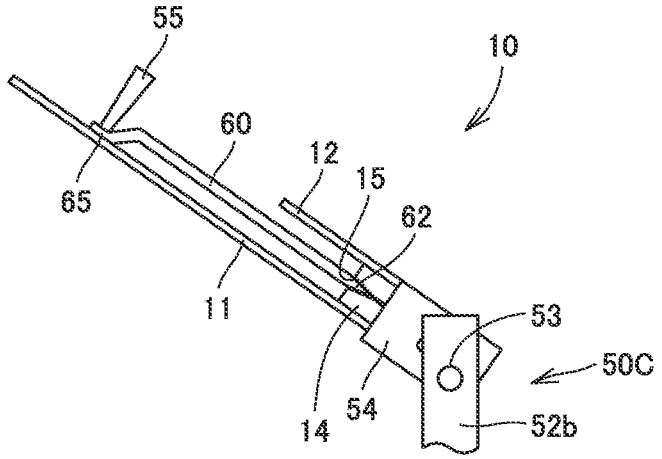
FIG. 17 is a side view showing a first state of the developer filling apparatus according to the fourth embodiment.
Figure 18:
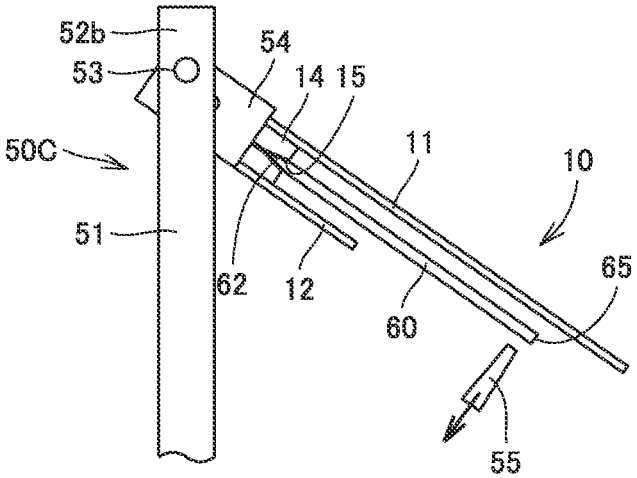
FIG. 18 is a side view showing a second state of the developer filling apparatus according to the fourth embodiment.

FIG. 17 is a side view showing a first state of the developer filling apparatus according to the fourth embodiment. FIG. 18 is a side view showing a second state of the developer filling apparatus according to the fourth embodiment. An operation of developer filling apparatus 100C according to the fourth embodiment will be described with reference to FIGS. 17 and 18.

As shown in FIG. 17, in the first state, developer bag 60 has been opened and fixed to bag setting portion 10 with mouth 65 up. Mouth 65 is pressed and closed by pressing portion 55.

As shown in FIG. 18, in the second state, bag setting portion 10 pivots such that bag setting portion 10 in the portion located on the side of mouth 65 is oriented to transfer path 30 while opened developer bag 60 is fixed to bag setting portion 10. In this state, mouth 65 of developer bag 60 is oriented to opening 31*a* of hopper portion 31. Furthermore, pressing portion 55 is distant from mouth 65 and mouth 65 is open.

Thus, in developer filling apparatus 100C according to the fourth embodiment, pressing portion 55 presses mouth 65 of developer bag 60 and bag setting portion 10 pivots while mouth 65 is closed. Thus, leakage of the developer from mouth 65 to the outside while bag setting portion 10 pivots can be suppressed.

After bag setting portion 10 pivots, pressing of mouth 65 by pressing portion 55 is canceled so as to open mouth 65. The developer can thus be introduced through mouth 65 into hopper portion 31.

(Developer Filling Method)

Figure 19:
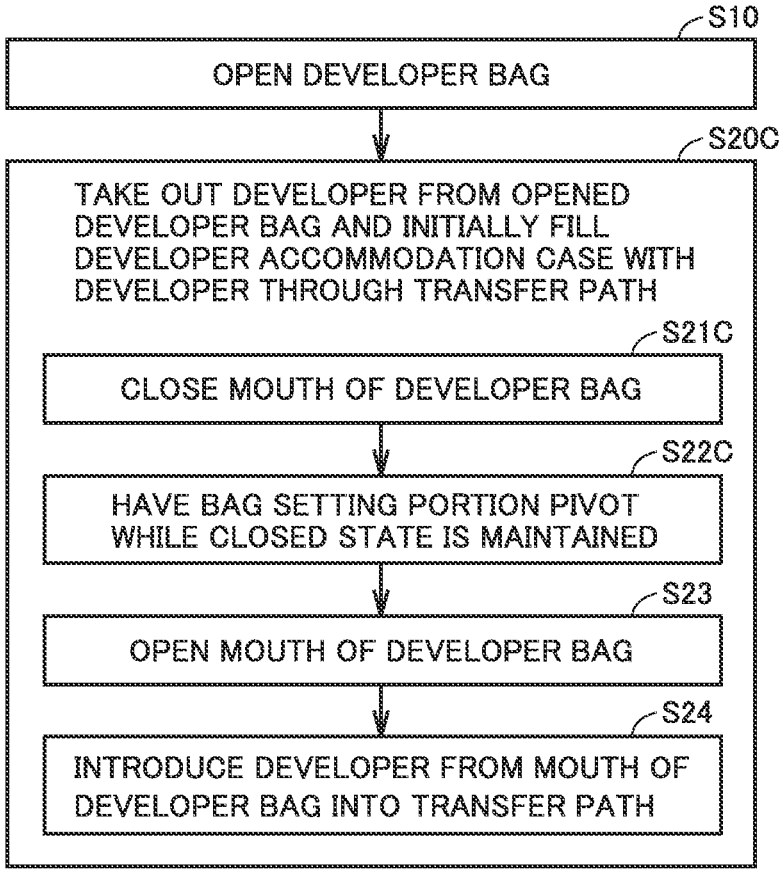
FIG. 19 is a flowchart of a developer filling method according to the fourth embodiment.

FIG. 19 is a flowchart of a developer filling method according to the fourth embodiment. The developer filling method according to the fourth embodiment will be described with reference to FIG. 19.

As shown in FIG. 19, in the developer filling method according to the fourth embodiment, developer bag 60 is opened in step S10. Specifically, the process substantially the same as in the first embodiment is performed.

Then, in a step S20C, the developer is taken out of opened developer bag 60 and developer accommodation case 70 is initially filled therewith through transfer path 30. Step S20C includes steps S21C, S22C, S23, and S24.

In performing step S20C, mouth 65 of developer bag 60 is closed in step S21C. Specifically, pressing portion 55 presses mouth 65 of opened developer bag 60.

Then, in step S22C, bag setting portion 10 pivots while the closed state of developer bag 60 is maintained specifically, bag setting portion 10 pivots such that bag setting portion 10 in the portion located on the side of mouth 65 is oriented to transfer path 30 while opened developer bag 60 is fixed to bag setting portion 10 and the pressing portion presses mouth 65.

Then, in step S23, mouth 65 of developer bag 60 is opened. Specifically, pressing of mouth 65 by pressing portion 55 is canceled by moving pressing portion 55 away from mouth 65.

Then, in step S24, the developer is introduced through mouth 65 of developer bag 60 into transfer path 30. Developer accommodation case 70 is initially filled with the developer introduced into transfer path 30, through transfer path 30.

With developer filling apparatus 100C and the developer filling method according to the fourth embodiment as above, an effect substantially equivalent to that in the first embodiment is obtained.

By using pressing portion 55 to close mouth 65 of developer bag 60 and having bag setting portion 10 pivot, unexpected scattering of the developer in pivot of bag setting portion 10 can be suppressed and loss in amount of filling due to scattering can be suppressed.

Fifth Embodiment

Figure 20:
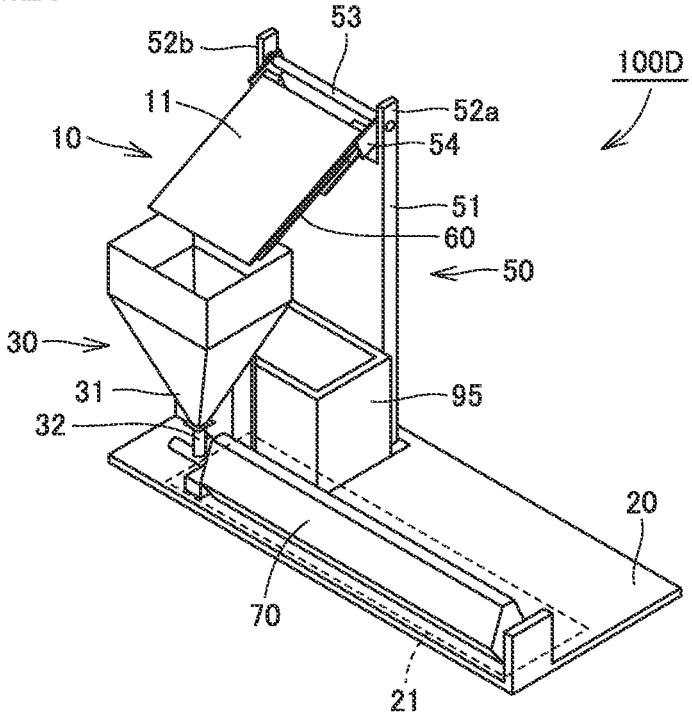
FIG. 20 is a perspective view showing a state that the bag setting portion is located at an introduction position in a developer filling apparatus according to a fifth embodiment.
Figure 21:
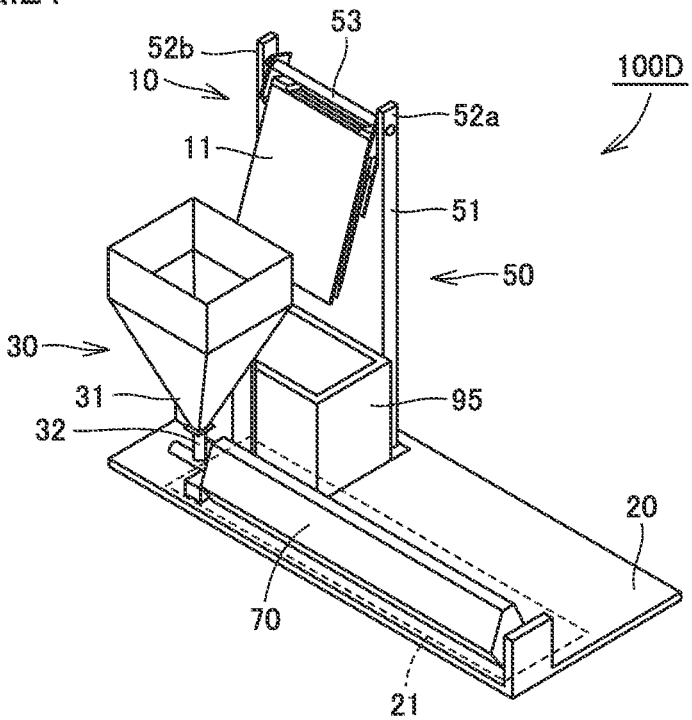
FIG. 21 is a perspective view showing a state that the bag setting portion is located at a dump position in the developer filling apparatus according to the fifth embodiment.

FIG. 20 is a perspective view showing a state that the bag setting portion is located at an introduction position in a developer filling apparatus according to a fifth embodiment. FIG. 21 is a perspective view showing a state that the bag setting portion is located at a dump position in the developer filling apparatus according to the fifth embodiment. A developer filling apparatus 100D according to the fifth embodiment will be described with reference to FIGS. 20 and 21.

As shown in FIGS. 20 and 21, developer filling apparatus 100D according to the fifth embodiment is different from developer filling apparatus 100 according to the first embodiment in including a dump portion 95 and otherwise substantially the same in construction.

Dump portion 95 is in a form, for example, of a box which opens upward. Dump portion 95 is located on a front side in the direction of pivot relative to transfer path 30 in the direction of pivot of bag setting portion 10 when bag setting portion 10 pivots such that opened developer bag 60 is oriented to transfer path 30. Dump portion 95 is provided between transfer path 30 and support base 51. The developer bag after the developer is introduced into transfer path 30 is dumped into dump portion 95.

As shown in FIG. 21, in dumping developer bag 60 from which the developer has been discharged, the pivot mechanism further has bag setting portion 10 pivot from the introduction position at which the developer can be introduced into transfer path 30 so as to move bag setting portion 10 to the dump position located above dump portion 95.

Developer bag 60 can be dumped into dump portion 95 by canceling fixing of developer bag 60 by fixing portion 14 of bag setting portion 10 in this state.

Figure 22:
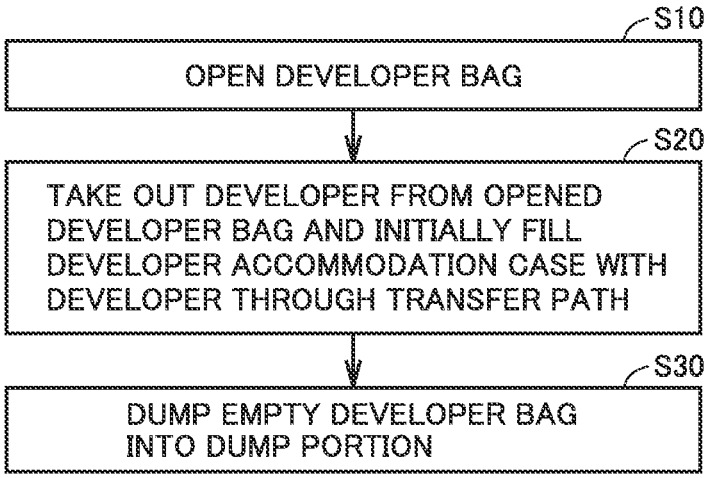
FIG. 22 is a flowchart of a developer filling method according to the fifth embodiment.

FIG. 22 is a flowchart of a developer filling method according to the fifth embodiment. The developer filling method according to the fifth embodiment will be described with reference to FIG. 22.

As shown in FIG. 22, in the developer filling method according to the fifth embodiment, the process substantially the same as in the first embodiment is performed in steps S10 and S20.

Then, in a step S30, empty developer bag 60 is dumped into dump portion 95. Specifically, bag setting portion 10 further pivots from the introduction position at which the developer can be introduced into transfer path 30 so as to move bag setting portion 10 to the dump position located above dump portion 95. Fixing of developer bag 60 by bag setting portion 10 is canceled in this state. Developer bag 60 is thus dumped from bag setting portion 10 into dump portion 95.

With developer filling apparatus 100D and the developer filling method according to the fifth embodiment as above, an effect substantially equivalent to that in the first embodiment is obtained.

By further having bag setting portion 10 pivot from the introduction position at which the developer can be introduced into transfer path 30 to move bag setting portion 10 to the dump position located above dump portion 95, empty developer bag 60 can be disposed with a simplified construction and a simplified method. It is no longer necessary to provide a conveying apparatus for separately conveying developer bag 60 for dumping and to separately provide a component such as an actuator.

Sixth Embodiment (Developer Filling Apparatus)

Figure 23:
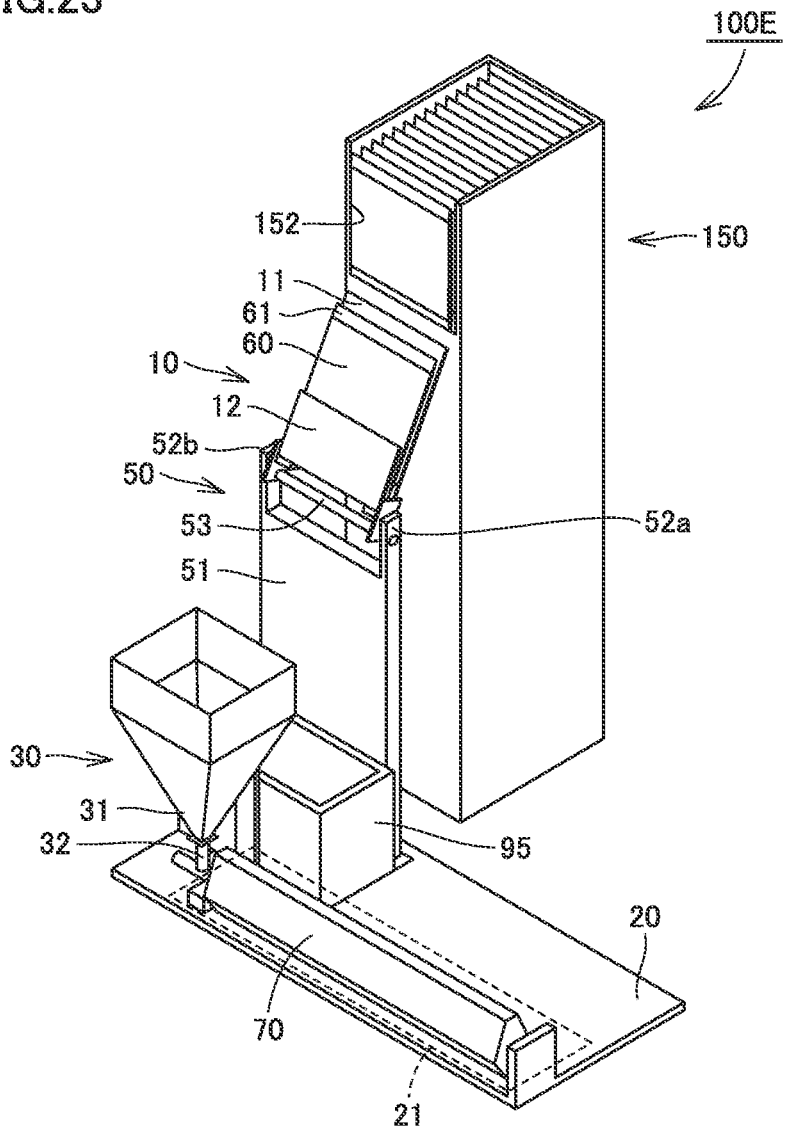
FIG. 23 is a perspective view showing a developer filling apparatus according to a sixth embodiment.

FIG. 23 is a perspective view showing a developer filling apparatus according to a sixth embodiment. A developer filling apparatus 100E according to the sixth embodiment will be described with reference to FIG. 23.

As shown in FIG. 23, developer filling apparatus 100E according to the sixth embodiment is different from developer filling apparatus 100D according to the fifth embodiment in including a bag accommodation portion 150 and a transport apparatus 155 (see FIG. 24) and otherwise substantially the same in construction.

Bag accommodation portion 150 accommodates a plurality of unopened developer bags 60. The plurality of developer bags 60 are accommodated in rows with fused portion 61 up. Bag accommodation portion 150 is located opposite to a side where transfer path 30 is located with respect to bag setting portion 10. Bag accommodation portion 150 is constructed to move developer bag 60 to bag setting portion 10.

Bag accommodation portion 150 includes an ejection port 152 for ejecting accommodated developer bag 60 toward bag setting portion 10. Ejection port 152 is located above bag setting portion 10. Developer bag 60 ejected from ejection port 152 is set in bag setting portion 10.

Figure 24:
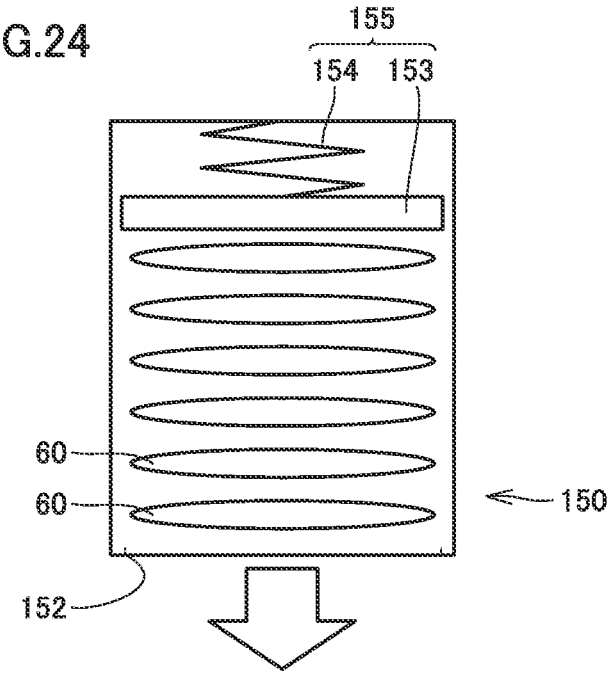
FIG. 24 is a schematic top view of a bag accommodation portion and a transport apparatus arranged in the bag accommodation portion according to the sixth embodiment.

FIG. 24 is a schematic top view of the bag accommodation portion and the transport apparatus arranged in the bag accommodation portion according to the sixth embodiment. Transport apparatus 155 will be described with reference to FIG. 24.

Transport apparatus 155 transports developer bag 60 accommodated in bag accommodation portion 150 to bag setting portion 10. Transport apparatus 155 includes an elastic member 154 and a pushing member 153.

Pushing member 153 is in a form of a flat plate. Pushing member 153 is constructed to abut on developer bag 60. Pushing member 153 is disengageably engaged with bag accommodation portion 150. While pushing member 153 is engaged with bag accommodation portion 150, pushing member 153 is unable to move with respect to bag accommodation portion 150. When pushing member 153 is disengaged, pushing member 153 is movable with respect to bag accommodation portion 150.

Elastic member 154 is fixed to an inner wall of bag accommodation portion 150 located opposite to ejection port 152. Elastic member 154 is compressed toward the inner wall by pushing member 153. Elastic member 154 is biased in a direction to push developer bag 60 toward ejection port 152.

By disengaging pushing member 153 described above at prescribed timing, pushing member 153 pushes the plurality of developer bags 60 toward ejection port 152 with biasing force of elastic member 154. Developer bag 60 closest to ejection port 152 is thus pushed out of ejection port 152. After developer bag 60 is pushed out, pushing member 153 is engaged with bag accommodation portion 150. By repeating this process, developer bags 60 are ejected from ejection port 152 one by one. Developer bag 60 ejected from ejection port 152 moves to bag setting portion 10.

(Developer Filling Method)

Figure 25:
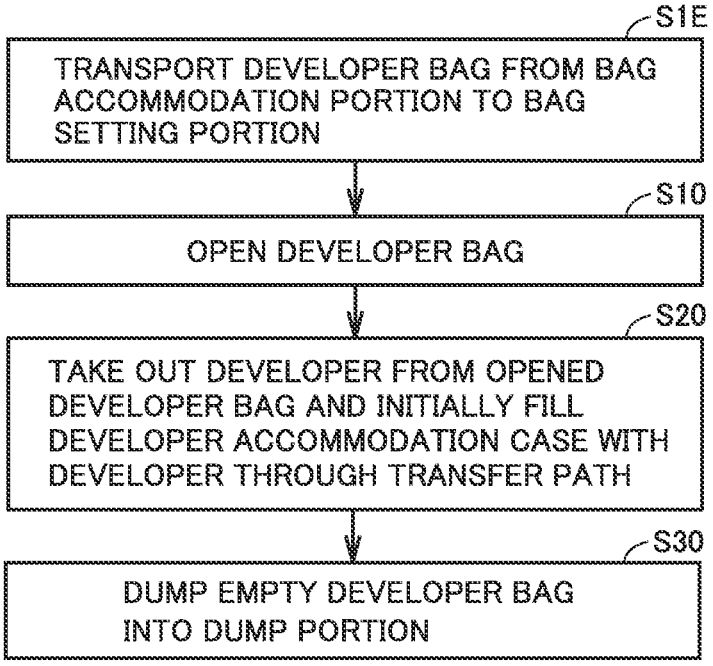
FIG. 25 is a flowchart of a developer filling method according to the sixth embodiment.

FIG. 25 is a flowchart of a developer filling method according to the sixth embodiment. The developer filling method according to the sixth embodiment will be described with reference to FIG. 25.

As shown in FIG. 25, in the developer filling method according to the sixth embodiment, in a step S1E, developer bag 60 is transported from bag accommodation portion 150 to bag setting portion 10. In succession, the process substantially the same as in the fifth embodiment is performed in steps S10, S20, and S30.

With developer filling apparatus 100E and the developer filling method according to the sixth embodiment as above, an effect substantially equivalent to that in the fifth embodiment is obtained.

By providing bag accommodation portion 150 which accommodates a plurality of developer bags 60 and transporting developer bag 60 from bag accommodation portion 150 to bag setting portion 10, developer bag 60 can readily be set in bag setting portion 10.

Though an example in which pushing member 153 and elastic member 154 implement transport apparatus 155 and pushing member 153 pushes developer bag 60 out of ejection port 152 to transport developer bag 60 to bag setting portion 10 is described by way of example in the sixth embodiment, limitation thereto is not intended. For example, the transport apparatus may be constructed to include an arm portion and a holding portion which is provided at a tip end of the arm portion to hold developer bag 60. In this case, the holding portion holds developer bag 60 accommodated in bag accommodation portion 150 and the arm portion is moved to transport developer bag 60 from bag accommodation portion 150 to bag setting portion 10.

Seventh Embodiment

Figure 26:
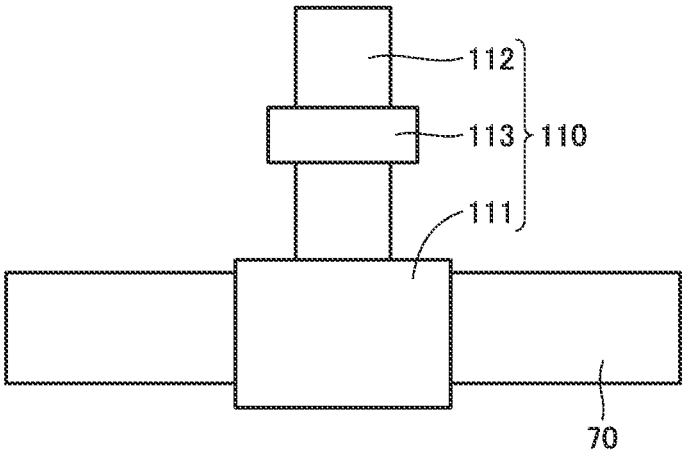
FIG. 26 is a schematic diagram showing a state of conveyance of a developer accommodation case by a conveying portion equipped in a developer filling apparatus according to a seventh embodiment.

FIG. 26 is a schematic diagram showing a state of conveyance of the developer accommodation case by a conveying portion equipped in a developer filling apparatus according to a seventh embodiment. The developer filling apparatus according to the seventh embodiment will be described with reference to FIG. 26.

As shown in FIG. 26, the developer filling apparatus according to the seventh embodiment is different from developer filling apparatus 100 according to the first embodiment in including a conveying portion 110 and otherwise substantially the same in construction.

Conveying portion 110 conveys developer accommodation case 70 initially filled with the developer from accommodation case setting portion 21. Conveying portion 110 includes a holding portion 111, an arm portion 112, and a weighing portion 113.

Holding portion 111 is provided on a side of a tip end of arm portion 112. Holding portion 111 is constructed to hold developer accommodation case 70. Arm portion 112 is constructed to be movable by a not-shown drive portion. Arm portion 112 is constructed to be movable, for example, in a vertical direction, a front-rear direction, and a lateral direction.

Weighing portion 113 weighs developer accommodation case 70 initially filled with the developer. An amount of developer with which developer accommodation case 70 is filled can thus be controlled. Since weighing portion 113 is provided in conveying portion 110, the weighing portion is able to weigh developer accommodation case 70 while it is being conveyed.

Figure 27:
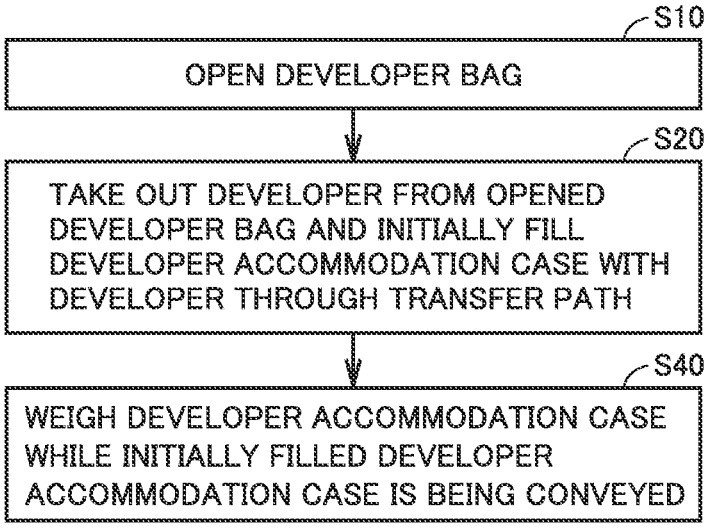
FIG. 27 is a flowchart of a developer filling method according to the seventh embodiment.

FIG. 27 is a flowchart of a developer filling method according to the seventh embodiment. The developer filling method according to the seventh embodiment will be described with reference to FIG. 27.

As shown in FIG. 27, in the developer filling method according to the seventh embodiment, the process substantially the same as in the first embodiment is performed in steps S10 and S20.

In a step S40, the initially filled developer accommodation case is weighed while the developer accommodation case is being conveyed. Specifically, while filled developer accommodation case 70 is being conveyed by conveying portion 110, filled developer accommodation case 70 is weighed by weighing portion 113.

With developer filling apparatus 100 and the developer filling method according to the seventh embodiment as above, an effect substantially equivalent to that in the first embodiment is obtained.

By providing weighing portion 113 in conveying portion 110, developer accommodation case 70 can be weighed while it is being conveyed. It is thus unnecessary to separately provide a measurement portion which weighs developer accommodation case 70 which has initially been filled and a manufacturing process can be simplified. Increase in takt time for checking a weight can be suppressed. An amount of developer with which developer accommodation case 70 is filled can be controlled.

(Developer Filling Apparatus According to Another First Modification)

Figure 28:
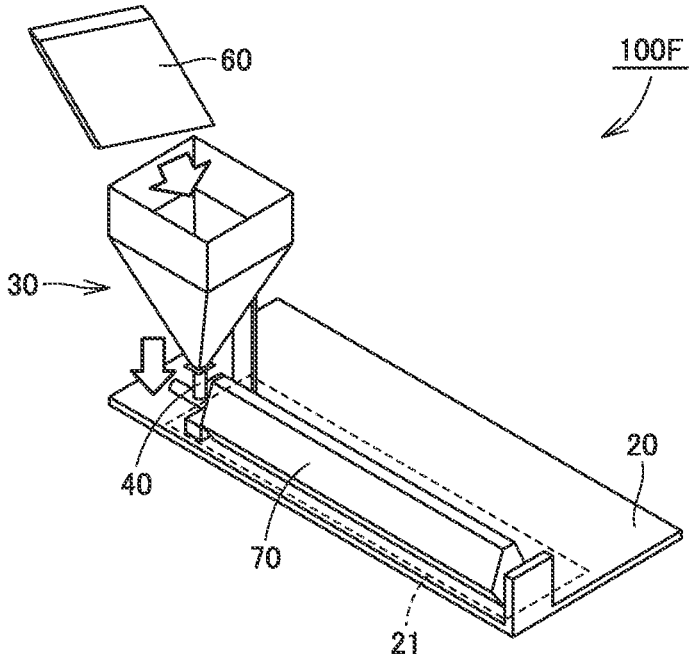
FIG. 28 is a perspective view showing a developer filling apparatus according to another first modification.

FIG. 28 is a perspective view showing a developer filling apparatus according to another first modification. A developer filling apparatus 100F according to another modification will be described with reference to FIG. 28.

As shown in FIG. 28, developer filling apparatus 100F according to another modification is different from developer filling apparatus 100 according to the first embodiment in not including bag setting portion 10 and posture change portion 50 and otherwise substantially the same in construction.

In developer filling apparatus 100F, an operator or a conveying apparatus conveys developer bag 60 which has been opened at another location to transfer path 30 and orients the mouth of developer bag 60 to opening 31*a* of hopper portion 31.

(Developer Filling Method)

Though a developer filling method according to another modification is basically in conformity with the developer filling method according to the first embodiment, step S10 of opening developer bag 60 is performed at a location distant from a location where developer filling apparatus 100F is set. Developer bag 60 is opened with a cutting tool such as a cutter and scissors. In step S20, a conveying apparatus or a user that conveys developer bag 60 introduces the developer from developer bag 60 into transfer path 30 with the mouth of opened developer bag 60 being oriented to transfer path 30.

An effect substantially the same as in the first embodiment is obtained even when such a developer filling method is employed.

(Developer Filling Apparatus According to Another Second Modification)

Figure 29:
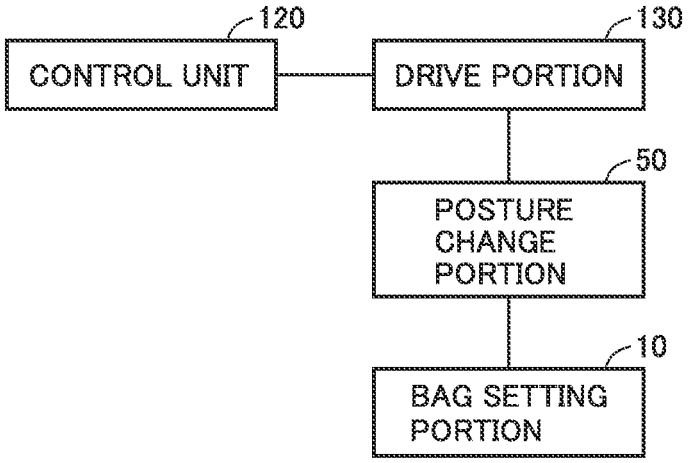
FIG. 29 is a block diagram showing a control configuration of a developer filling apparatus according to another second modification.

FIG. 29 is a block diagram showing a part of a control configuration of a developer filling apparatus according to another second modification. The developer filling apparatus according to another second modification will be described with reference to FIG. 29.

As shown in FIG. 29, the developer filling apparatus according to another second modification is different from developer filling apparatus 100 according to the first embodiment in that a control unit 120 controls an operation of posture change portion 50 by controlling a drive portion 130 which drives posture change portion 50.

Control unit 120 drives a motor or the like as drive portion 130 to thereby move the pivot mechanism of posture change portion 50 and have bag setting portion 10 pivot.

An angle of pivot of bag setting portion 10 may be sensed with an encoder or the like. A pivot angle sensing unit may be implemented by an optical sensor and a light shield element and pivot of bag setting portion 10 to a prescribed position may be sensed when the light shield element which has pivoted with pivot of bag setting portion 10 interferes light reception by the optical sensor.

The developer filling apparatus according to another second modification obtains an effect substantially the same as in the first embodiment even when bag setting portion 10 thus pivots.

The developer filling method based on the present invention described above includes opening a developer bag in which a developer containing toner and a carrier is sealed and taking out the developer from the opened developer bag and initially filling a developer accommodation case with the developer through a transfer path.

The developer filling method based on the present invention preferably further includes vibrating the developer by the time when the developer accommodation case is filled with the developer.

In the developer filling method based on the present invention, in the vibrating the developer, the developer bag may be vibrated with the developer being sealed in the developer bag.

The developer filling apparatus based on the present invention includes a bag setting portion where a developer bag in which a developer containing toner and a carrier is sealed is set, an accommodation case setting portion where a developer accommodation case for accommodating the developer is set, and a transfer path constructed to initially fill the developer accommodation case set in the accommodation case setting portion with the developer taken out of the opened developer bag while the developer bag is set in the bag setting portion.

In the developer filling apparatus based on the present invention, the transfer path preferably includes a hopper portion constructed to store the developer taken out of the developer bag and a feed path constructed to feed the developer from the hopper portion into the developer accommodation case.

The developer filling apparatus based on the present invention may further include a posture change portion which changes a posture of the developer bag such that a mouth of the opened developer bag is oriented to the transfer path with the developer bag being set in the bag setting portion.

In the developer filling apparatus based on the present invention, preferably, the bag setting portion includes a fixing portion constructed to fix the developer bag, and the posture change portion preferably includes a pivot mechanism which has the bag setting portion pivot such that the bag setting portion in a portion located on a side of the mouth is oriented to the transfer path.

In the developer filling apparatus based on the present invention, preferably, the developer bag includes an accommodation portion in which the developer is accommodated and a fused portion for hermetically sealing the developer in the accommodation portion. In this case, the fixing portion preferably holds the fused portion in a portion which remains on a side of the accommodation portion with the developer bag having been opened.

In the developer filling apparatus based on the present invention, the pivot mechanism may be constructed to have the bag setting portion pivot by 180 degrees or more.

In the developer filling apparatus based on the present invention, the posture change portion may include a pressing portion constructed to press the mouth to allow opening and closing of the mouth. In this case, the bag setting portion pivots with the mouth being closed by being pressed with the pressing portion, and the mouth is preferably opened by canceling pressing of the mouth with the pressing portion after the bag setting portion pivots.

The developer filling apparatus based on the present invention may further include a dump portion where the developer bag is dumped after the developer is introduced into the transfer path. In this case, the pivot mechanism preferably moves the bag setting portion to a dump position located above the dump portion by further having the bag setting portion pivot from an introduction position where the developer can be introduced into the transfer path.

The developer filling apparatus based on the present invention preferably further includes a vibration portion which vibrates the developer by the time when the developer accommodation case is filled with the developer.

In the developer filling apparatus based on the present invention, the vibration portion may be provided in the bag setting portion. In this case, the vibration portion preferably vibrates the developer accommodated in the developer bag set in the bag setting portion by vibrating the bag setting portion.

In the developer filling apparatus based on the present invention, the vibration portion may be provided in the transfer path. In this case, the vibration portion preferably vibrates the developer introduced into the transfer path by vibrating the transfer path.

In the developer filling apparatus based on the present invention, preferably, the bag setting portion is constructed such that the developer bag is set as being inclined with respect to a horizontal plane.

The developer filling apparatus based on the present invention may further include a bag accommodation portion which accommodates a plurality of developer bags.

The developer filling apparatus based on the present invention may further include a transport apparatus which transports the developer bag accommodated in the bag accommodation portion to the bag setting portion.

In the developer filling apparatus based on the present invention, the developer bag preferably includes an accommodation portion where the developer is accommodated and a fused portion for hermetically sealing the developer in the accommodation portion. In this case, the developer filling apparatus preferably further includes a cutting mechanism which cuts the developer bag in a portion located on a side of the accommodation portion relative to the fused portion.

In the developer filling apparatus based on the present invention, the cutting mechanism may include a rotary blade which rotates around a rotation shaft. In this case, the developer bag is opened by the rotary blade which moves in a direction in parallel to a direction of extension of the fused portion while the rotary blade is rotating.

In the developer filling apparatus based on the present invention, the cutting mechanism may include a plate-shaped blade which extends in a direction in parallel to a direction of extension of the fused portion. In this case, the developer bag is preferably opened by being pressed by the plate-shaped blade.

The developer filling apparatus based on the present invention may further include a conveying portion which conveys the developer accommodation case initially filled with the developer from the accommodation case setting portion. In this case, the conveying portion preferably includes a weighing portion which weighs the developer accommodation case initially filled with the developer.

Although embodiments of the present invention have been described and illustrated in detail, the disclosed embodiments are made for the purposes of illustration and example only and not limitation. The scope of the present invention should be interpreted by terms of the appended claims.

What is claimed is:

1. A developer filling apparatus comprising:

a bag setting portion;

a developer bag in which a developer containing toner and a carrier is sealed set in the bag setting portion, the developer bag including an accommodation portion in which the developer is accommodated and a fused portion for hermetically sealing the developer in the accommodation portion;

an accommodation case setting portion;

a developer accommodation case for accommodating the developer set in the accommodation case setting portion;

a transfer path constructed to initially fill the developer accommodation case set in the accommodation case setting portion with the developer taken out of the opened developer bag while the developer bag is set in the bag setting portion; and a posture change portion which changes a posture of the bag setting portion such that a mouth of the opened developer bag is oriented to the transfer path with the developer bag being set in the bag setting portion, wherein the bag setting portion includes a fixing portion constructed to hold the fused portion to thereby fix the opened developer bag to the bag setting portion at a portion of the opened developer bag opposite the mouth, and the posture change portion includes a pivot mechanism which has the bag setting portion pivot such that the bag setting portion in a portion located on a side of the mouth is oriented to the transfer path, the pivot mechanism being located closer to the fixing portion than the mouth when the developer bag is set in the bag setting portion with the fixing portion holding the fused portion so that the mouth moves further than the fixing portion when the posture change portion changes the posture of the bag setting portion.

2. The developer filling apparatus according to claim 1, wherein the transfer path includes a hopper portion constructed to store the developer taken out of the developer bag and a feed path constructed to feed the developer from the hopper portion to the developer accommodation case.

3. The developer filling apparatus according to claim 1, wherein the pivot mechanism is constructed to have the bag setting portion pivot by 180 degrees or more.

4. The developer filling apparatus according to claim 1, wherein the posture change portion includes a pressing portion constructed to press the mouth to allow opening and closing of the mouth, the bag setting portion pivots with the mouth being closed by being pressed with the pressing portion, and the mouth is opened by canceling pressing of the mouth with the pressing portion after the bag setting portion pivots.

5. The developer filling apparatus according to claim 1, the developer filling apparatus further comprising a dump portion where the developer bag is dumped after the developer is introduced into the transfer path, wherein the pivot mechanism moves the bag setting portion to a dump position located above the dump portion by further having the bag setting portion pivot from an introduction position where the developer can be introduced into the transfer path.

6. The developer filling apparatus according to claim 1, the developer filling apparatus further comprising a vibration portion constructed to vibrate the developer by a time when the developer accommodation case is filled with the developer.

7. The developer filling apparatus according to claim 6, wherein the vibration portion is provided in the bag setting portion and vibrates the developer accommodated in the developer bag set in the bag setting portion by vibrating the bag setting portion.

8. The developer filling apparatus according to claim 6, wherein the vibration portion is provided in the transfer path and vibrates the developer introduced into the transfer path by vibrating the transfer path.

9. The developer filling apparatus according to claim 1, wherein the bag setting portion is constructed such that the developer bag is set as being inclined with respect to a horizontal plane.

10. The developer filling apparatus according to claim 1, the developer filling apparatus further comprising a bag accommodation portion which accommodates a plurality of the developer bags.

11. The developer filling apparatus according to claim 10, the developer filling apparatus further comprising a transport apparatus which transports the developer bag accommodated in the bag accommodation portion to the bag setting portion.

12. The developer filling apparatus according to claim 1, wherein the developer filling apparatus further comprises a cutting mechanism which cuts the developer bag in a portion located on a side of the accommodation portion relative to the fused portion.

13. The developer filling apparatus according to claim 12, wherein the cutting mechanism includes a rotary blade which rotates around a rotation shaft, and the developer bag is opened by the rotary blade which moves in a direction in parallel to a direction of extension of the fused portion while the rotary blade is rotating.

14. The developer filling apparatus according to claim 12, wherein the cutting mechanism includes a plate-shaped blade which extends in a direction in parallel to a direction of extension of the fused portion, and the developer bag is opened by being pressed by the plate-shaped blade.

15. The developer filling apparatus according to claim 1, the developer filling apparatus further comprising a conveying portion which conveys the developer accommodation case initially filled with the developer from the accommodation case setting portion, wherein the conveying portion includes a weighing portion which weighs the developer accommodation case initially filled with the developer.

* * * * *